US005749196A

United States Patent [19]

Bangma

[11] Patent Number: 5,749,196

[45] Date of Patent: May 12, 1998

[54] BUILDING AND BUILDING ELEMENT THEREFOR

[75] Inventor: Pier Bangma, Abbega, Netherlands

[73] Assignee: Buro Eco-Home, Netherlands

[21] Appl. No.: 682,534

[22] PCT Filed: Jan. 27, 1995

[86] PCT No.: PCT/NL95/00038

§ 371 Date: Jul. 25, 1996

§ 102(e) Date: Jul. 25, 1996

[87] PCT Pub. No.: WO95/20709

PCT Pub. Date: Aug. 3, 1995

[30] Foreign Application Priority Data

Jan. 27, 1994 [NL] Netherlands ..... 9400124

[51] Int. Cl.[6] ..... E04B 1/02

[52] U.S. Cl. ..... 52/561; 52/572; 52/592.6; 52/309.4; 446/127

[58] Field of Search ..... 52/561, 563, 564, 52/565, 568, 569, 570, 571, 586.1, 586.2, 585.1, 589.1, 591.1, 591.5, 592.1, 592.2, 592.3, 592.4, 592.5, 592.6, 309.4, 309.6, 572; 446/124, 127, 122

[56] References Cited

U.S. PATENT DOCUMENTS

| | | | |
|---|---|---|---|
| 3,618,279 | 11/1971 | Sease | 52/563 |
| 4,301,637 | 11/1981 | Anderson | 52/594 |
| 4,854,103 | 8/1989 | Klym | 52/593 |
| 5,090,064 | 2/1992 | Breitenberger . | |
| 5,598,675 | 2/1997 | Pruss | 52/309.4 |

FOREIGN PATENT DOCUMENTS

| | | | |
|---|---|---|---|
| 327465 | 2/1976 | Austria | E04B 602/14 |
| 2545127 | 11/1984 | France | 52/561 |
| 2582035 | 11/1986 | France | E04G 11/06 |
| 846453 | 8/1952 | Germany | 52/591.1 |
| 3236187 | 4/1984 | Germany | 52/561 |
| 2550240 | 5/1977 | Netherlands | E04C 1/18 |
| 3915628 | 10/1990 | Netherlands | C04B 18/26 |
| 1010715 | 11/1965 | United Kingdom | 52/309.4 |
| 8001185 | 6/1980 | WIPO . | |

*Primary Examiner*—Creighton Smith
*Attorney, Agent, or Firm*—Mark Zovko

[57] ABSTRACT

The invention relates to a building structure of a number of construction elements each comprising two plate-like side parts (2) which are mutually connected at a distance parallel to each other by at least one connecting part (3) which protrudes partially outside the periphery of these side parts (2) and fitting between side parts of an adjoining construction element (1). The connecting part (3) extends between the side parts over a distance in the order of magnitude of half the width of the side parts and over a substantially equal distance outside the side parts. The connecting parts (3) of adjoining construction elements (1) preferably leave spaces between each other so that the building structure substantially has one continuous interspace. The interspace can be filled with curing material.

12 Claims, 4 Drawing Sheets

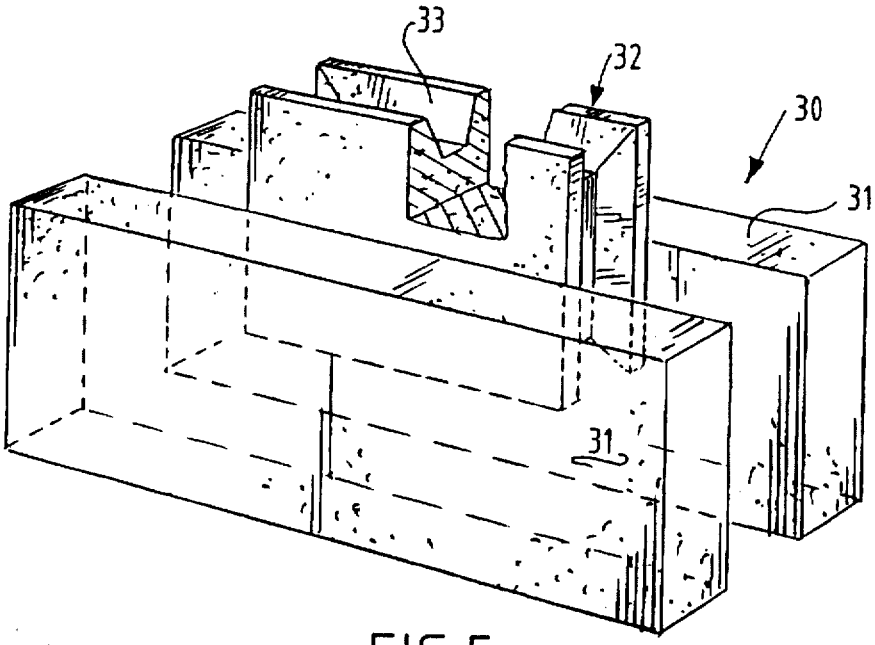
FIG.5
FIG.6
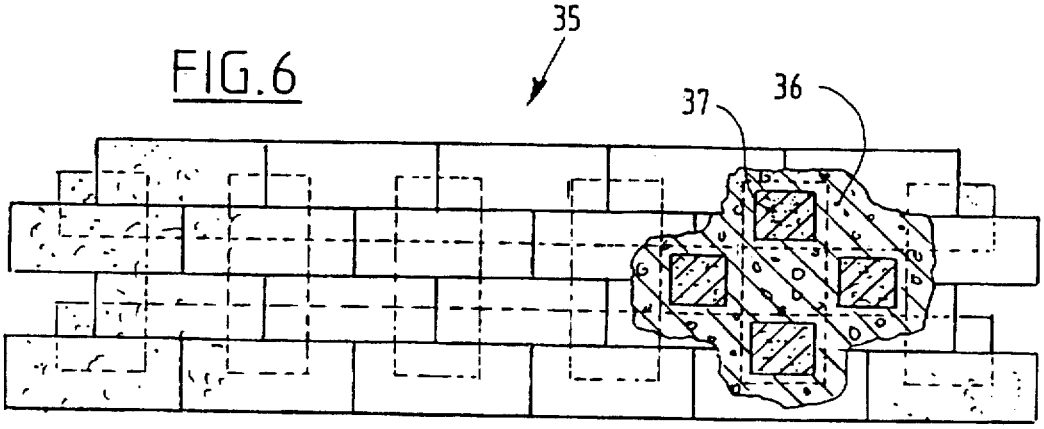

BUILDING AND BUILDING ELEMENT THEREFOR

The invention relates to a building structure and a construction element with which this building structure can be solidly erected in simple manner.

Many construction elements are known. In addition to the bricks known for a considerable time, large construction elements are known which are intended to enable quicker erection of a building structure. However, large construction elements have the drawback of a greater weight. The large construction elements known today are usually so heavy that they can no longer be handled by one person without assist means. The profit gained using such large construction elements as a result of more rapid working is partly nullified because machines have to be used to shift the construction elements.

The invention now has for its object to provide a construction element which, while having sizable dimensions, has a limited weight such that it can still be handled by one person without machines. A building structure manufactured with such construction elements is characterized in claim 1. A considerable interspace can be present between the plate-like side parts so that a comparatively low weight can still be achieved with considerable outer dimensions of the construction element. Because the connecting part of each construction element protrudes in close-fitting manner between side parts of an adjoining construction element the construction elements of the building structure fit together firmly, whereby a solid construction is obtained. For particular applications the structure can even be assembled from dry stacked construction elements. The cohesion of the construction elements is sufficiently great therefor.

A suitable embodiment is herein characterized in claim 3. The curing binder joins the filler extending through the adjoining spaces between the side parts of the elements to a cohesive whole, whereby the construction elements are likewise unified into a cohesive, solid building structure.

A very favourable further development is characterized in claim 5. The building structure can be erected very easily by stacking the construction elements on one another. The interspace is subsequently filled with concrete so that a cohesive, structurally bearing entity results. Due to the insulating effect of the side parts of the construction elements the heat released by curing of the concrete is not released, whereby the concrete acquires a high temperature and very quickly attains a basic strength which enables further construction.

A very favourable development is characterized in claim 6. The part of the connecting element protruding outside the side parts extends in a half-brick bond at the position of the joint of the adjoining layer of construction elements. The construction elements are hereby accurately aligned relative to each other so that without special steps a smooth, straight wall can be erected in exceptionally simple manner.

Achieved in favourable manner with the step of claim 7 is that the upper surface of the connecting parts of one layer of construction elements comes to lie substantially at the same level as the lower surface of the connecting parts of the layer of construction elements lying thereabove. It is hereby possible during erection of a wall of the construction elements to lay conduits on the connecting parts, optionally after these latter have been provided with a recess, wherein these conduits are then fixed by the layer of construction elements to be arranged thereabove.

Application of the step of claim 8 enables building with the construction elements of walls which stand at a mutual angle of 90°.

A favourable further development is characterized in claim 9. The construction element characterized therein makes possible a very attractive rounded corner between two walls.

A suitably manufactured construction element according to the invention is characterized in claim 10. Plate-like material can generally be manufactured at relatively low cost so that the construction element assembled from these plate-like parts can likewise be manufactured at relatively low cost.

A suitable material for the construction element according to the invention is characterized in claim 11.

The invention is further elucidated in the following description with reference to the embodiments shown in the figures.

FIG. 5 shows a perspective view of a construction element according to another embodiment.

FIG. 6 shows a partly broken away view of a building structure manufactured with the construction element of FIG. 5.

Figure 1:
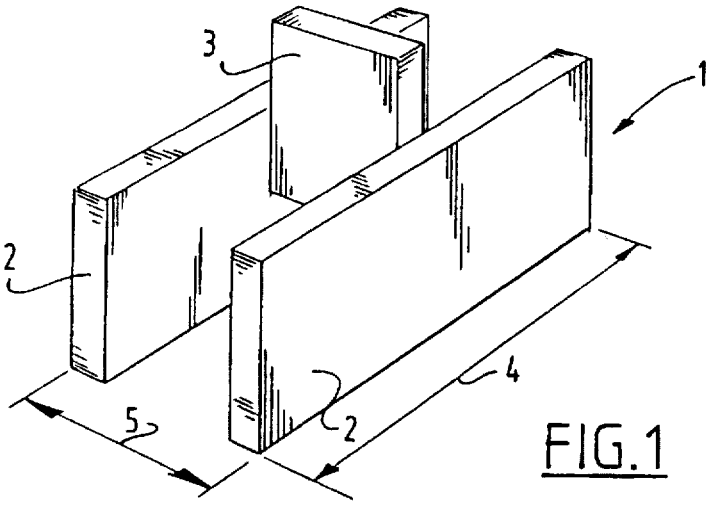
FIG. 1 is a perspective view of a construction element according to an embodiment of the invention.

The construction element according to the invention shown in FIG. 1 comprises two plate-like side parts 2 which are mutually connected at a distance parallel to each other by a connecting part 3. In this preferred embodiment the connecting part 3 is likewise plate-like and connected to side parts 2 by glueing.

As shown in FIG. 1, the side parts 2 of construction element 1 are rectangular and the connecting part 3 is arranged midway along the side parts and extends transversely of the side parts 2 therebetween. Connecting part 3 extends over half the height between side parts 2 and protrudes substantially the same distance above side parts 2. Connecting part 3 thus has itself a height which is roughly equal to the height of side parts 2. Further, the length 4 of construction element 1 is twice the width 5.

Figure 2:
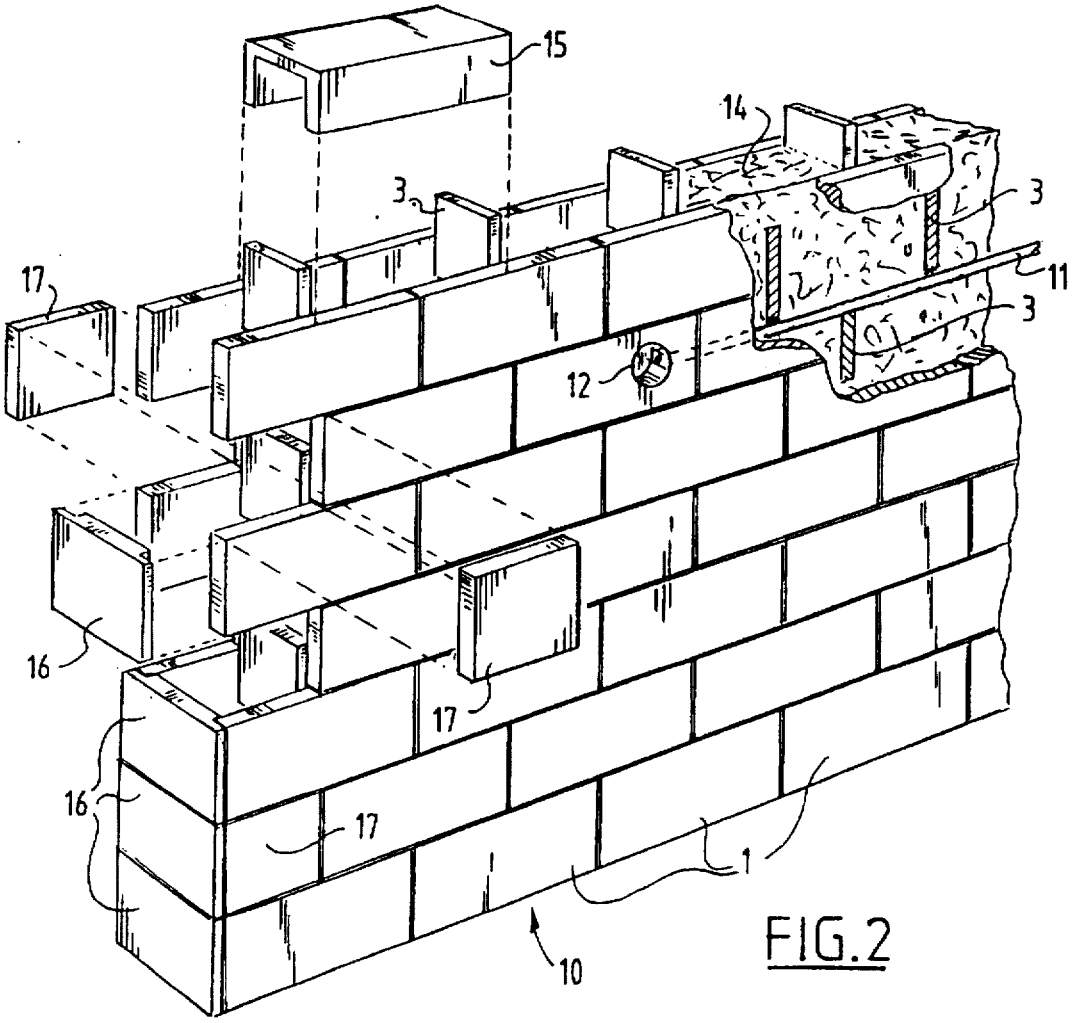
FIG. 2 is a partly broken away perspective view, partially with exploded parts, of a building structure manufactured with the construction elements of FIG. 1.

FIG. 2 shows a building structure 10 in the form of a wall erected with construction elements 1. The latter are arranged in a half-brick bond. It will be apparent that, of a construction element, the portion of the connecting part 3 extending above side parts 2 protrudes between the side parts of the construction element located thereabove. Due to the half-brick bond the protruding portions of connecting parts 3 protrude precisely at the position of the joint between two successive construction elements. The side parts of these successive construction elements are thereby accurately positioned mutually in line. These side parts are herein simultaneously positioned in the same plane as the side part lying thereunder. This mutual relationship applies to all construction elements, so that the side parts 2 of all construction elements come to lie precisely in one plane. The wall 10 constructed in this way thus becomes automatically straight and smooth without special steps.

Because the connecting parts 3 of the construction elements 1 have the same height as the side parts 2, the upper sides of the connecting parts of one layer of construction elements lie in practically the same plane as the lower sides of the connecting parts of the layer of construction elements lying thereabove.

In the wall 10 this property is utilized by laying on the connecting parts of the third layer from the top a conduit 11 which is subsequently fixed by the connecting parts 3 of the second layer from the top. When this conduit 11 is a rigid conduit, a recess is formed in the upper part of the connecting parts, for instance by sawing off a corner thereof. The conduit 11 shown in FIG. 2 is an electrical conduit which runs out into a box 12 and through which electrical wiring is fed to the box 12. If use is made of flexible conduits, recesses do not have to be arranged in the protruding portions of the connecting parts 3.

As will be apparent from FIG. 2, a very considerable hollow space is present between the mutually connecting side parts of the construction elements. According to a preferred embodiment of the invention this space is filled with insulating material 14 after erection of the structure. This insulating material 14 can be any suitable insulating material, such as ceramic or glass fibre, foam or the like.

In preference however, this insulating material is a filler poured separately into the space and impregnated with a curing binder. Favourable is for instance a filler consisting of chippings of waste wood impregnated with a cement-containing binder.

When the wall 10 has reached the intended height, it is not finished on the top, but the filler in the form of chippings of waste wood is poured into the hollow space in the wall, whereafter thin liquid cement mortar is poured from above over the binder in a quantity such that it can seep to the bottom of the space. After curing of the cement mortar the insulating material 14 forms a coherent entity with a good insulating value which moreover mutually joins the construction elements to a fully integrated whole. The wall 10 can thus be erected by dry stacking and the mutual cohesion is ensured by the cured filler of the insulating material as well as by the mechanical cohesion of the mutually engaging construction elements.

The wall 10 of FIG. 2 is finished at the top by placing cover elements 15 thereon. These cover elements are also positioned accurately by the protruding portions of the connecting parts 3.

Instead of using cover elements 15 the upper layer of construction elements can be placed upside down, wherein the protruding portions of connecting parts 3 thus protrude downward. The top side of the wall can then be finished with flat cover elements 15.

The head end of wall 10 is finished with closing elements 16 which have the same thickness as the connecting parts 3 and are provided on the edges with grooves over half the thickness so that a thickened portion is formed extending between the side parts. At the position of the staggered construction elements filler elements 17 are arranged which are half the size of side parts 2. The closing elements 16 can be arranged shifted in height direction for instance through half the height of the side parts, so that the filler elements lie on one side against a protruding portion of connecting part 3 and on the other side against the projecting portion of the closing element 16 and are thus positioned accurately in the side surface.

The closing elements 16 can also be used if two mutually perpendicular walls must be mutually joined at a corner position. The distance between the outer surface of an arranged closing element 16 and the side surface of connecting part 3 facing toward the same side is equal to the width 5 of a construction element, so that such a corner solution can be formed in a manner usual for a half-brick bond.

Figure 3:
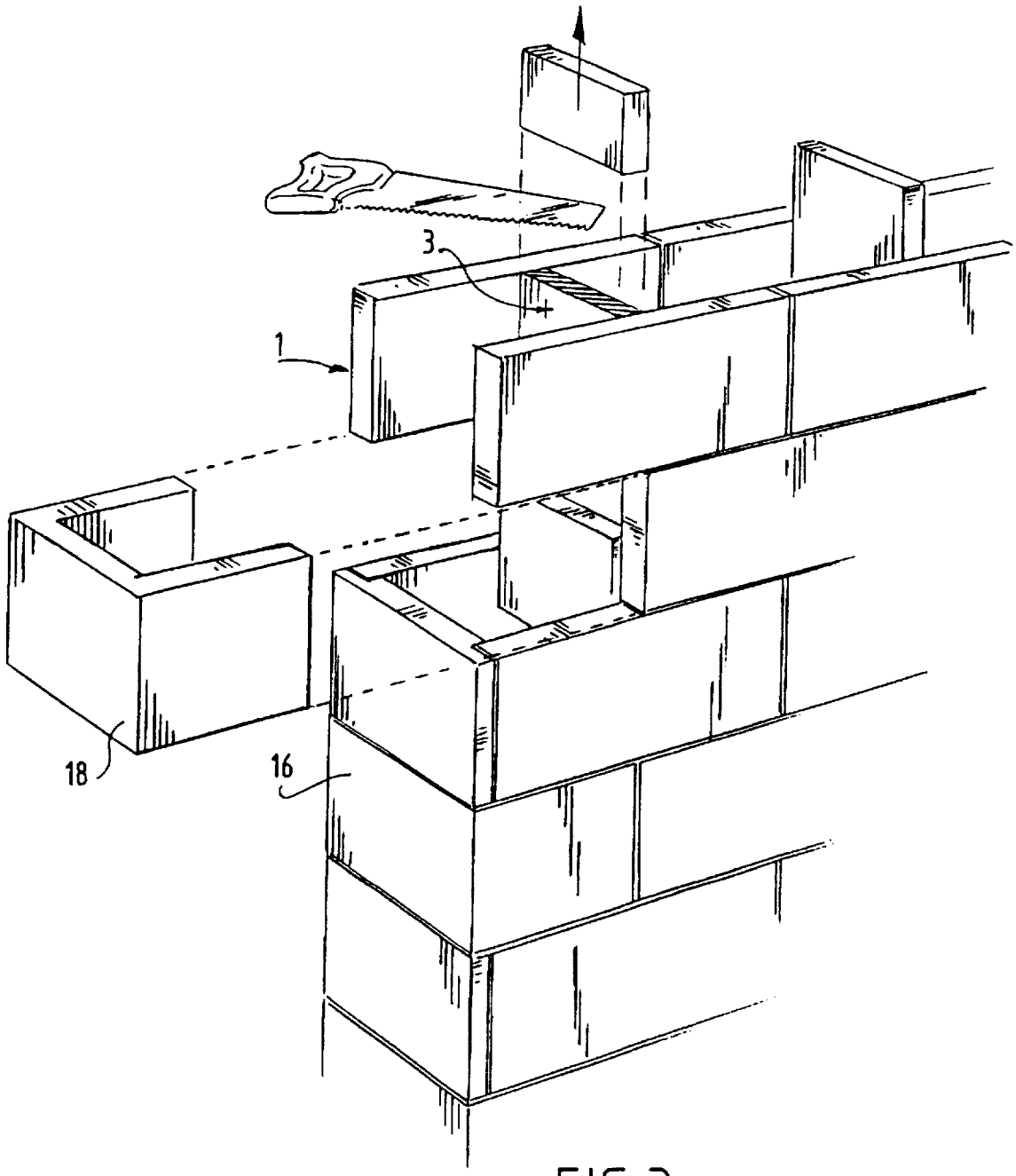
FIG. 3 is a view partly corresponding with FIG. 2 of a slightly different embodiment of the building structure according to the invention.

FIG. 3 shows an alternative solution for the head end of a wall. A U-shaped closing element 18 is herein applied which fits precisely into the recesses of toughly half the size of a construction element. On the top of the wall the protruding connecting parts 3 can be sawn off to enable a flat finish of the top side of the wall.

Figure 4:
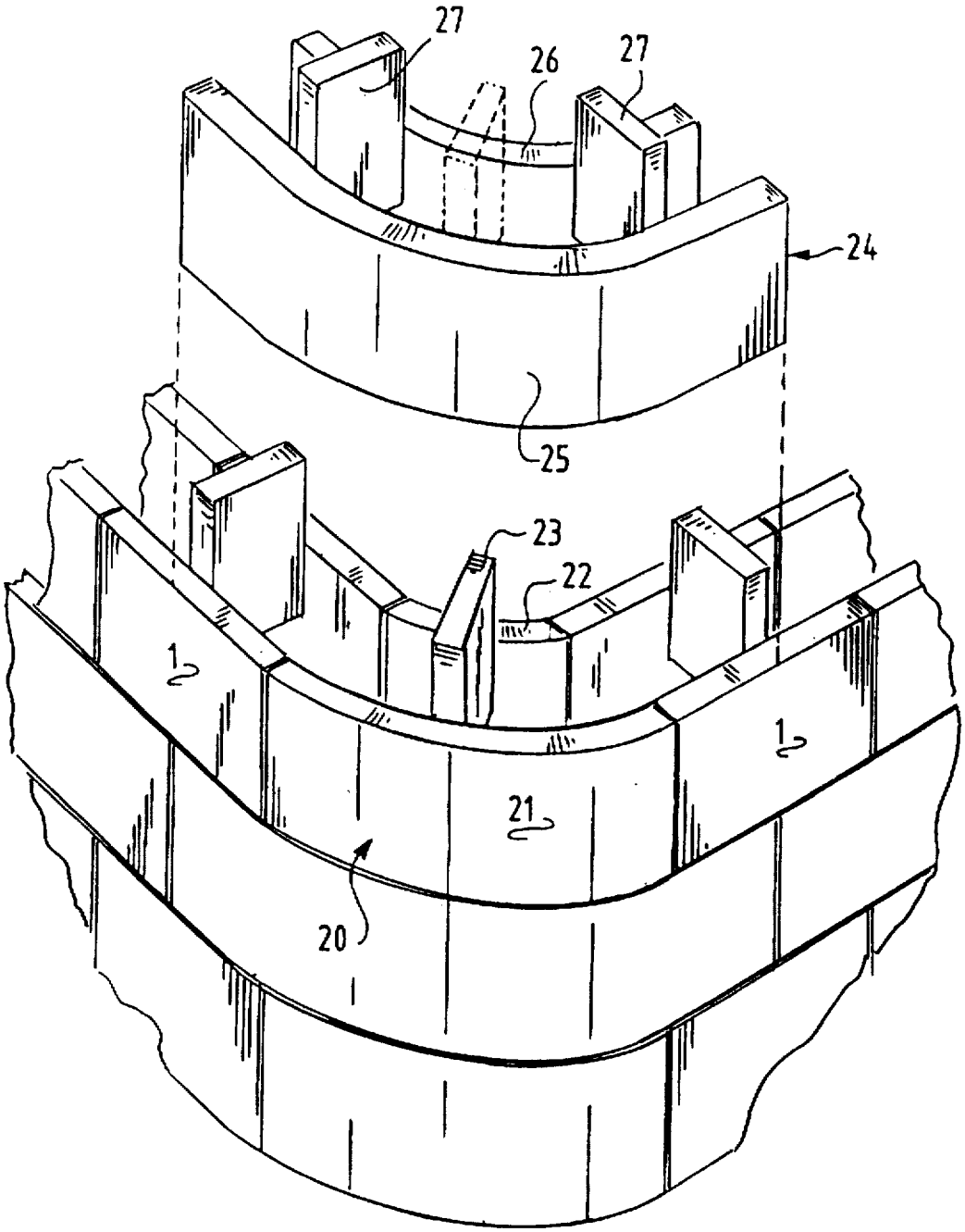
FIG. 4 shows a partial view with partially exploded parts of another embodiment of the building structure according to the invention.

FIG. 4 shows a corner solution with special construction elements 20, 24, whereby a rounded corner is formed. The construction element 20 has two plate-like side parts 21, 22 which are not flat but curved relative to a common centre lying outside the element. The side parts 21 and 22 are herein both curved through an angle of 90°. A connecting part 23 is once again arranged in the middle between the side parts 21.

In order to be able to also continue the half-brick bond at the location of this corner solution, a second construction element 24 is necessary, the side parts 25, 26 of which have the same form as side parts 21, 22 respectively of the construction element 20, with on either side an extension half the size of a side part of a construction element 1. This construction element 24 is provided with two connecting parts which are arranged staggered in the correct manner in relation to the connecting part 23 of a construction element 20 lying thereunder. For strength an additional connecting part can optionally be used as designated with dashed lines in FIG. 4.

Although in the figures a vertical wall is shown in each case as building structure according to the invention, such a structure can also be a floor construction. Due to the good cohesion of the construction elements in the structure according to the invention a good bearing capacity can be achieved. Because the construction elements can be used in both vertical walls and horizontal floors a large diversity of constructions is possible.

A suitable material for the construction elements is foamed concrete. The construction elements hereby become light in weight and acquire a high insulating value. Other materials are of course possible. If materials are used with a good thermal conductivity the connecting parts can even be designed such that heat transfer via these connecting parts is minimalized. This can be achieved by arranging holes in these connecting parts whereby cold bridges are avoided as far as possible.

Another very suitable material for the construction elements according to the invention is polystyrene foam. FIG. 5 shows a construction element 30 manufactured from expanded polystyrene foam. Construction element 30 consists of two plate-like side parts 31 having therebetween a connecting part 32. In this embodiment the connecting part 32 is substantially square and equal in size to half a side part 31. Connecting part 32 is situated midway along the horizontal dimension of side part 31 and is shifted upward through half the height thereof.

As shown in FIG. 5, a V-shaped groove 33 is formed in the walls of connecting part 32. The interspace between the side parts 31 in a building structure 35 manufactured from construction elements 30 can be filled in very suitable manner with concrete 36. As FIG. 6 shows, the concrete forms a continuous structural part which can absorb the forces acting on a building structure 35. The outer surfaces of the building structure can be finished with a plaster.

The embodiments of the construction element according to the invention shown in the figures are only examples and many other options fall within the scope of the claims. Each construction element can thus contain more than one connecting part. A possibility is for instance a variant of the construction element 1 wherein an extra connecting part is arranged at one end and protruding over half the thickness between the side parts. A construction element is further possible wherein the side parts are shifted parallel to their plane relative to each other. One possibility is a shift through half the length of a side part, with two connecting parts, each one midway along each of the side parts. All of these and other possible embodiments are included in the invention as lying within the scope of the claims.

I claim:

1. Building structure of a number of construction elements each comprising two plate-like side parts having dimensions defining an outer perimeter, which are mutually connected at a distance parallel to each other by at least one connecting part which protrudes partially outside the outer perimeter of these side parts in a certain direction and fits between side parts of an adjoining construction element, characterized in that said connecting part extends between said side parts over a distance in said certain direction of substantially half the dimension of said side parts and over a substantially equal distance outside said side parts, and said connecting parts of adjoining construction elements having spaces between each other so that the structure substantially has a plurality of mutually connected interspaces defining one continuous interspace within the structure.

2. The building structure of claim 1 wherein said connecting part extends between said side parts over a distance in said certain direction greater than half the dimension of said side parts.

3. The building structure of claim 1 wherein said connecting part extends between said side parts over a distance in said certain direction less than half the dimension of said side parts.

4. Building structure as claimed in claim 1, wherein the interspace is filled with curing material.

5. Building structure as claimed in claim 1, wherein the construction elements are manufactured from aerated material.

6. Building structure as claimed in claims 1 wherein the construction elements are manufactured from insulating foam material and the interspace is filled with concrete.

7. The building structure of claim 6 wherein said insulating foam material is expanded polystyrene foam.

8. Construction element as claimed in claim 6, wherein said side parts are rectangular having a length and width and one connecting part is present midway along said side parts which extends transversely of the length of said side parts.

9. Construction element as claimed in claim 6 wherein said side parts are rectangular having a length and width and the length thereof is twice as great as the dimension of the construction element transversely of said side parts.

10. Construction element for a building structure as claimed in claim 1, wherein said two plate-like side parts have a curved portion defined by a radius drawn from a common center lying outside said element and extended through a predetermined angle.

11. Construction element for a building structure as claimed in claim 6, wherein said plate-like side parts and at least one of said connecting parts are joined together by glue.

12. The building structure as claimed in claim 1 wherein said construction elements are manufactured from foamed concrete.

* * * * *